US006488006B2

(12) United States Patent
Pursifull

(10) Patent No.: US 6,488,006 B2
(45) Date of Patent: Dec. 3, 2002

(54) ELECTRONIC THROTTLE IDLE SPEED CONTROL SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 50 days.

(21) Appl. No.: 09/815,084

(22) Filed: Mar. 22, 2001

(65) Prior Publication Data

US 2002/0134349 A1 Sep. 26, 2002

(51) Int. Cl.[7] ..... F02M 3/07

(52) U.S. Cl. ..... 123/339.25; 123/399

(58) Field of Search ..... 123/361, 399, 123/339.25, 339.26

(56) References Cited

U.S. PATENT DOCUMENTS 5,014,667 A * 5/1991 Meyer ..... 123/360
5,992,383 A * 11/1999 Scholten et al. ..... 123/399
6,157,888 A * 12/2000 Suzio et al. ..... 123/399
6,274,993 B1 * 8/2001 Itabashi et al. ..... 123/361

* cited by examiner

*Primary Examiner*—Erick Solis
(74) *Attorney, Agent, or Firm*—John E. Kajander

(57) ABSTRACT

A method for controlling a positioning device of an internal combustion engine includes the steps of: providing an electric motor for actuating the positioning device; detecting a position of the positioning device in relationship to a stop; determining whether the positioning device is near the stop; enabling overshoot when the positioning device is not near the stop; determining a velocity of the positioning device; and, enabling overshoot of the positioning device when the positioning device is near the stop, but the velocity is below a predetermined value.

17 Claims, 1 Drawing Sheet

ELECTRONIC THROTTLE IDLE SPEED CONTROL SYSTEM

TECHNICAL FIELD

The present invention relates generally to control systems for internal combustion engines, and more particularly, to an electronic throttle idle speed control system.

BACKGROUND ART

Many previously known motor vehicle throttle controls have a direct physical linkage between an accelerator pedal and the throttle so that the throttle plate is pulled open by the accelerator cable as the driver depresses the pedal. The direct mechanical linkage includes a biasing force that defaults the linkage to a reduced operating position, in a manner consistent with regulations. Nevertheless, such mechanisms are often simple and unable to adapt fuel consumption efficiency to changing traveling conditions, and add significant weight and components to the motor vehicle.

An alternative control for improving throttle control and the precise introduction of fuel air mixtures into the engine cylinders is provided by electronic throttle controls. The electronic throttle control includes a throttle control unit that positions the throttle plate by an actuator controlled by a microprocessor based on the current operating state determined by sensors. The processors are often included as part of a powertrain electronic control that can adjust the fuel air intake and ignition in response to changing conditions of vehicle operation as well as operator control. Protection may be provided so that an electronic system does not misread or misdirect the control and so that unintended operation is avoided when portions of the electronic control suffer a failure.

For controller simplicity, a single controller structure for all ranges and modes of operation is desired. However, the plant under control (throttle actuator) has high coulomb friction torque relative to its inertia and motor torque. This results in long times from command to 90% of final value for small command changes. Unfortunately, times need to be small for good idle speed control. These times can be improved by increasing the gains, but results in adding overshoot. While in some cases beneficial, overshoot, in general, will cause the throttle mechanism to strike the stops, which can cause mechanism failure or require significant and costly added robustness to the mechanism.

The disadvantages associated with these conventional electronic throttle idle control techniques have made it apparent that a new technique for electronic throttle idle control is needed. The new technique should have short times from command to 90% of final value for small command changes. Additionally, the new technique should not cause mechanism failure or require significant and costly added robustness to the mechanism. The present invention is directed to these ends.

SUMMARY OF THE INVENTION

It is, therefore, an object of the invention to provide an improved and reliable electronic throttle idle speed control system. Another object of the invention is to have short times from command to 90% of final value for small command changes.

In accordance with the objects of this invention, an electronic throttle idle speed control system is provided. In one embodiment of the invention, a method for controlling a positioning device of an internal combustion engine includes the steps of: providing an electric motor for actuating the positioning device; detecting a position of the positioning device in relationship to a stop; determining whether the positioning device is near the stop; enabling overshoot when the positioning device is not near the stop; determining a velocity of the positioning device; and, enabling overshoot of the positioning device when the positioning device is near the stop, but the velocity is below a predetermined value.

The present invention thus achieves an improved electronic throttle idle speed control system. The present invention is advantageous in that will not cause mechanism failure or require significant and costly added robustness to the mechanism.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
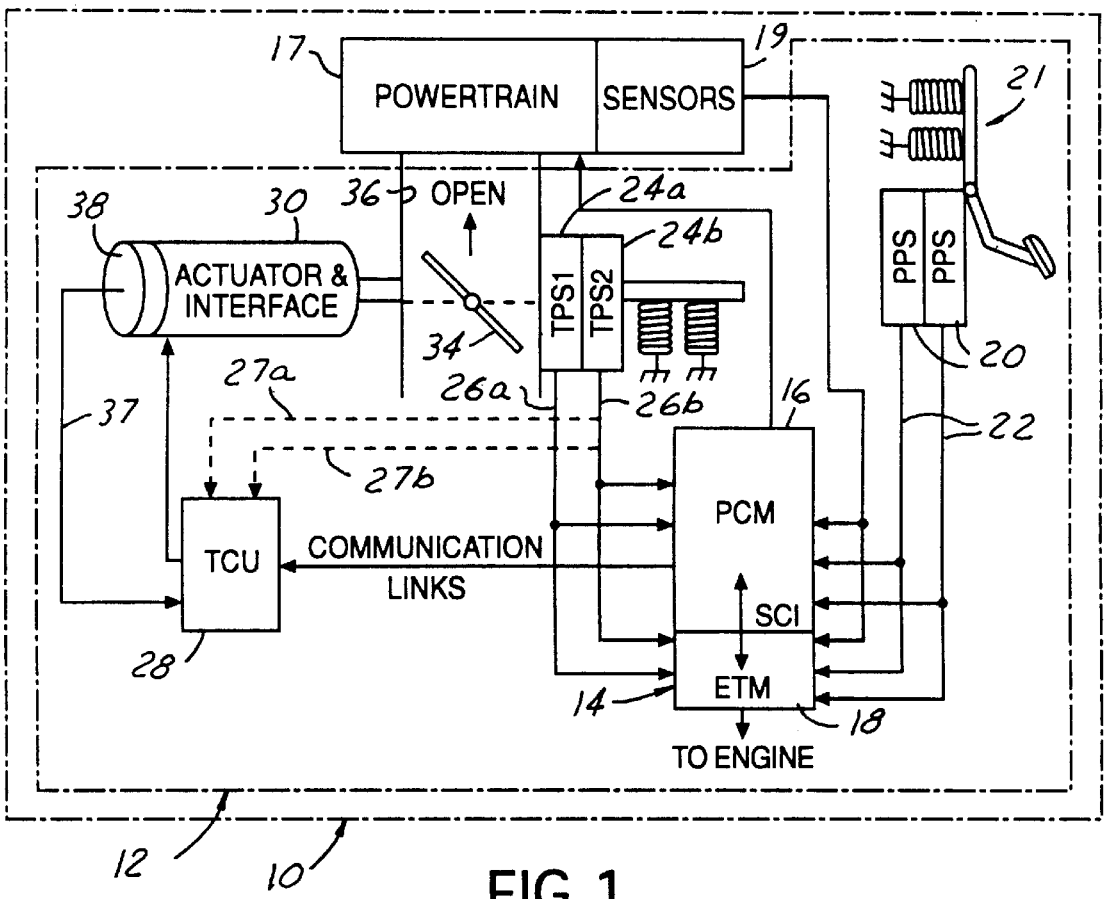
FIG. 1 is an electronic throttle idle speed control system in accordance with one embodiment of the present invention.

In the following figures, the same reference numerals will be used to identify identical components in the various views. The present invention is illustrated with respect to an electronic throttle idle speed control system, particularly suited for the automotive field. However, the present invention is applicable to various other uses that may require electronic throttle idle speed control systems.

Referring to FIG. 1, a motor vehicle powertrain system 10 including electronic throttle control system 12 includes an electronic control unit 14. In the preferred embodiment, the electronic control unit 14 includes a powertrain control module (PCM) 16 including a main processor and an electronic throttle monitor (ETM) 18 including an independent processor. The PCM and ETM share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for independent processing.

A wide variety of inputs are represented in the FIG. 1 diagram by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

For controller 16 simplicity, a single controller structure for all ranges and modes of operation is desired. However, the plant under control (throttle actuator 30) has high coulomb friction torque relative to its inertia and motor torque. In the prior art, this results in long times from command to 90% of final value for small command changes. Unfortunately, times need to be small for good idle speed control. These times can be improved by increasing the gains, but results in adding overshoot. While in some cases beneficial, overshoot, in general, will cause the throttle mechanism 34 to strike the stops, which can cause mechanism failure. The present invention solves this problem by using high gains in the idle region and low gains in the rest of the region. In this way, overshoot is permitted where there is no risk of large velocity stop strikes and prevented where stop strikes would otherwise be of large velocity.

Unfortunately, only using high gains in the idle region and low gains in the rest of the region may cause a problem, i.e., when the command steps from forty degrees to two degrees, any allowed overshoot is likely to result in a high velocity stop strike (the close stop is at 0°). Ideally, the present invention should have no overshoot when near either an open or close stop. However, the idle region near the close stop is where short times from command to 90% of final value for small command changes is desired. Therefore, in the present invention, if throttle plate 34 is very close to the close stop, the throttle cannot accelerate to a high velocity before contacting the close stop. This arrangement inherently limits the stop strike velocity and prevents mechanism damage. Therefore, once near a stop for a period of time, the gains can be safely increased such that overshoot is allowed.

Thus, there are conditions under which the present invention allows overshoot. First, the present invention allows throttle plate 34 to overshoot when it is away from either the open and close stops. Or second, the present invention allows throttle plate 34 to overshoot when near a stop, but only when the velocity of throttle plate 34 is small. One skilled in the art, would realize that if the position of throttle plate 34 has been near a stop of a period of time, then low velocity can be inferred.

The present invention thus achieves an improved and reliable electronic throttle idle speed control system by using high gains in the idle region and low gains in the rest of the throttle plate region. In this way, the present invention has short times from command to 90% of final value for small command changes when idling. Additionally, the present invention does not cause mechanism failure or require significant and costly added robustness to the mechanism.

From the foregoing, it can be seen that there has been brought to the art a new and improved electronic throttle idle speed control system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A method for controlling a positioning device of an internal combustion engine, the method comprising the steps of:

providing an electric motor for actuating said positioning device;

detecting a position of said positioning device in relationship to a stop;

determining whether said positioning device is away from said stop; and enabling overshoot of said positioning device when said positioning device is away from said stop.

2. The method as recited in claim 1, wherein said stop is a close stop.

3. The method as recited in claim 1, wherein said stop is an open stop.

4. The method as recited in claim 1, further comprising the step of disabling overshoot of said positioning device when said positioning device is close to said stop.

5. The method as recited in claim 2, further comprising the step of enabling overshoot of said positioning device when said positioning device is away from said close stop.

6. The method as recited in claim 2, further comprising the step of disabling overshoot of said positioning device when said positioning device is close to said close stop.

7. The method as recited in claim 3, further comprising the step of enabling overshoot of said positioning device when said positioning device is away from said open stop.

8. The method as recited in claim 3, further comprising the step of disabling overshoot of said positioning device when said positioning device is close to said open stop.

9. A method for controlling a positioning device of an internal combustion engine, the method comprising the steps of:

providing an electric motor for actuating said positioning device;

detecting a position of said positioning device in relationship to a stop;

determining whether said positioning device is near said stop;

determining a velocity of said positioning device; and enabling overshoot of said positioning device when said positioning device is near said stop and said velocity is below a predetermined value.

10. The method as recited in claim 9, wherein said stop is a close stop.

11. The method as recited in claim 9, wherein said stop is an open stop.

12. The method as recited in claim 9, further comprising the step of disabling overshoot of said positioning device when said positioning device is close to said stop and said velocity is above said predetermined value.

13. The method as recited in claim 10, further comprising the step of enabling overshoot of said positioning device when said positioning device is near said close stop and said velocity is below said predetermined value.

14. The method as recited in claim 10, further comprising the step of disabling overshoot of said positioning device when said positioning device is near said close stop and said velocity is above said predetermined value.

15. The method as recited in claim 11, further comprising the step of enabling overshoot of said positioning device when said positioning device is near said open stop and said velocity is below said predetermined value.

16. The method as recited in claim 11, further comprising the step of disabling overshoot of said positioning device when said positioning device is near said open stop and said velocity is above said predetermined value.

17. The method as recited in claim 9, wherein the step of determining a velocity of said positioning device comprises inferring said velocity when said positioning device has been near said stop for a predetermined period of time.

* * * * *